United States Patent [19]

Johnson

[11] 4,295,514

[45] Oct. 20, 1981

[54] BIFOLD DOOR HINGE ASSEMBLY

[75] Inventor: Larry K. Johnson, Sterling, Ill.

[73] Assignee: Lawrence Brothers, Inc., Sterling, Ill.

[21] Appl. No.: 94,289

[22] Filed: Nov. 14, 1979

Related U.S. Application Data

[63] Continuation of Ser. No. 910,106, May 30, 1978, abandoned.

[51] Int. Cl.[3] ..... E06B 3/00; E05D 7/10

[52] U.S. Cl. ..... 160/206; 16/128 R; 16/172

[58] Field of Search ..... 160/199, 206, 207, 229 R, 160/118; 16/135, 138, 139, 149, 169, 171, 172, 173, 174, 175, 178, 128 R

[56] References Cited

U.S. PATENT DOCUMENTS

| | | | |
|---|---|---|---|
| 193,208 | 7/1877 | Arnold | 16/128 R |
| 437,492 | 9/1890 | Herrick | 16/175 |
| 931,697 | 8/1909 | Maxwell | 16/128 R |
| 1,578,408 | 3/1926 | Diday | 16/172 |
| 2,618,809 | 11/1952 | Rubinoff | 16/172 |
| 2,778,053 | 1/1957 | Hess et al. | 16/171 |
| 2,860,701 | 11/1958 | Wood et al. | 160/206 |
| 3,577,584 | 5/1971 | Himelreich | 16/135 |
| 3,811,489 | 5/1974 | Thun et al. | 160/118 |

*Primary Examiner*—Rodney H. Bonck

*Attorney, Agent, or Firm*—Trexler, Bushnell & Wolters, Ltd.

[57] ABSTRACT

There is disclosed a hinge structure for a bifold door assembly or the like, which includes first and second leaf members, the first leaf member comprising a generally flat mounting or leaf portion and a knuckle portion. The knuckle portion includes one or more and preferably a pair of coaxial spaced, knuckle portions which are of a generally semi-circular or U-shaped configuration in cross section, thus defining generally open knuckles. The second leaf member includes a generally flat mounting or leaf portion and a knuckle portion comprising a generally cylindrical closed knuckle with a pair of rod-like pins extending coaxially therefrom. The axial length of the closed knuckle is such that it may be disposed between the open knuckles of the first leaf member and the outwardly extending pins received in the open, U-shaped knuckle portions. Upon assembly, the first leaf member is mounted so that the open knuckle portions are offset with respect to the door edge, with a surface portion of the door serving to cooperate with the open knuckle portions to confine the pin members and prevent lateral separation.

4 Claims, 7 Drawing Figures

BIFOLD DOOR HINGE ASSEMBLY

REFERENCE TO RELATED APPLICATION

Thus application is a continuation of U.S. Ser. No. 910,106, filed May, 30, 1978, now abandoned.

BACKGROUND OF THE INVENTION

This invention relates generally to a bifold door assembly and an improved hinge structure for joining the pivoted door to the guide door, and more particularly to a novel hinge structure which facilitates operation of the door and provides certain economic advantages with respect to fabrication of both the door and the hinge structure.

Bifold door structures are well known and typically include a pivoted door mounted proximate a vertical portion of the door frame and a guide door joined to the pivoted door by one or more hinge structures, and having the remote edge thereof confined for linear movement. The doors are normally mounted between a pair of parallel upper and lower guide tracks. In this regard, the pivoted door is pivotally mounted adjacent the door frame, generally proximate the upper and lower edges thereof, by pivot assemblies engaged in the respective guide tracks. That is to say, this door will merely pivot during opening and closing, with the edge adjacent the frame precluded against linear movement. The guide door is hingedly connected to the opposite edge of pivot door, with the guide door edge remote from said pivot door having pivot guide assemblies carried by the upper and lower edge portions, which assemblies are engaged in said guide tracks. As such, as the doors are opened, they will fold upon each other, in that the pivoted door merely pivots while the guided door is subjected to compound movement. More specifically, the guided door will pivot about the guide-pivot assemblies engaged in the tracks, however, the assemblies will slide along the track toward the pivoted door to produce the open condition. While the prior art hinge structures have generally been satisfactory in operation, certain problems have arisen in their use, and in the fabrication of the doors, as is discussed hereinafter.

Specifically, bifold type doors are generally mounted to open or fold outwardly of the space enclosed, such as a closet, cabinet, or the like. Hence, it is desirable for the fully opened bifold door structure to form an angle somewhat greater than 90° with respect to the guide tracks when fully open, to provide maximum access to the closet or the like. A related problem is that of maintaining relatively smooth, non-binding operation of the track mounted slide portions of the guided door. As will be described more fully hereinbelow and with reference to the drawings, many prior art hinge structures tend to encourage, rather than reduce the tendency for the guide pins to bind in the track during operation of the bifold door structure. As will be described, opening of the door structure to an angle greater than 90° serves to minimize this binding problem.

One prior art solution to the above problem as is illustrated in FIG. 3 and to be described, involves use of a standard type hinge wherein the hinge leaves are mounted to the rear face of the doors. While this arrangement will produce an open condition wherein the doors are positioned at an angle greater than 90°, other drawbacks result. More specifically, this door panel is normally predrilled to receive the pivot and pivot-guide hardware, respectively. However, the design of FIG. 3 requires that the pivoted door and guided door be drilled at different or non-symmetrical locations thus necessitating two different door panel designs. From a standpoint of economy of manufacture and assembly, such distinguishing of door panels is not desirable, since care must then be taken to assure that one of each type panel is included for each bifold door structure to be delivered to a customer, who normally effects assembly therein. Moreover, an installer must recognize the difference between the two door panels and take care to install them properly. In contrast, it is generally more desirable to provide identical door panels to minimize both the expense and difficulty of manufacture as well as of installation.

The problem of individual pre-drilling of the door panels can be overcome by use of a hinge mounted directly to the juxtaposed edge surfaces of the door, as shown in FIG. 2. With this arrangement, however, the doors cannot be opened beyond 90°, and as will be discussed, binding is a problem.

Accordingly, it is a general object of this invention to provide a new and improved hinge structure for a bifold type of door. Another object of this invention is to provide a hinge structure which allows opening of the door structure so as to form an angle greater than 90° with its guide track to minimize building of the guides with respect to the guide track, yet does not require specialized fabrication of the door panels. Yet another object of this invention is to provide a hinge structure which does not require preassembly by the manufacturer of the respective leaf members, yet is relatively simple to install, thereby minimizing both the difficulty of installation and the cost of manufacture.

Briefly, the present invention contemplates attaining the above objectives, and others by the provision of a hinge structure which comprises a first leaf member including a generally planar mounting or leaf portion, with at least one open, U-shaped knuckle portion, and a second leaf member including a generally planar mounting or leaf portion, having a closed knuckle portion with at least one rod-like pin member extending axially outwardly therefrom. The pin member is disposed within the U-shaped, open knuckle portion of the first leaf member, and the first leaf member is mounted, such that the aligned knuckle portions are offset with respect to the interface of the door edges, with the door surface to which the first leaf is mounted cooperating with the open portion to confine the pin member and prevent lateral separation.

Other objects, features and advantages of this invention will be appreciated upon consideration of the following detailed descriptions, together with the accompanying drawings wherein like reference numerals are used throughout to designate like elements and components.

DETAILED DESCRIPTION OF THE ILLUSTRATED EMBODIMENT

Before specific discussion is had relative to the hinge structure of the present invention, it will be instructive by way of background to review generally the construction of a typical bifold type of door mounting, with which the invention is advantageously utilized.

Figure 2:
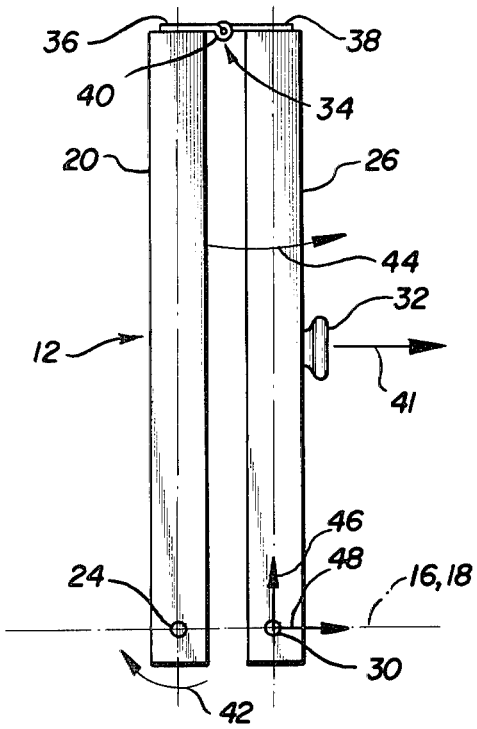
FIG. 2 PRIOR ART
FIG. 2 illustrates schematically, one section of a bifold door arrangement utilizing one type of prior art hinge mounting.
Figure 3:
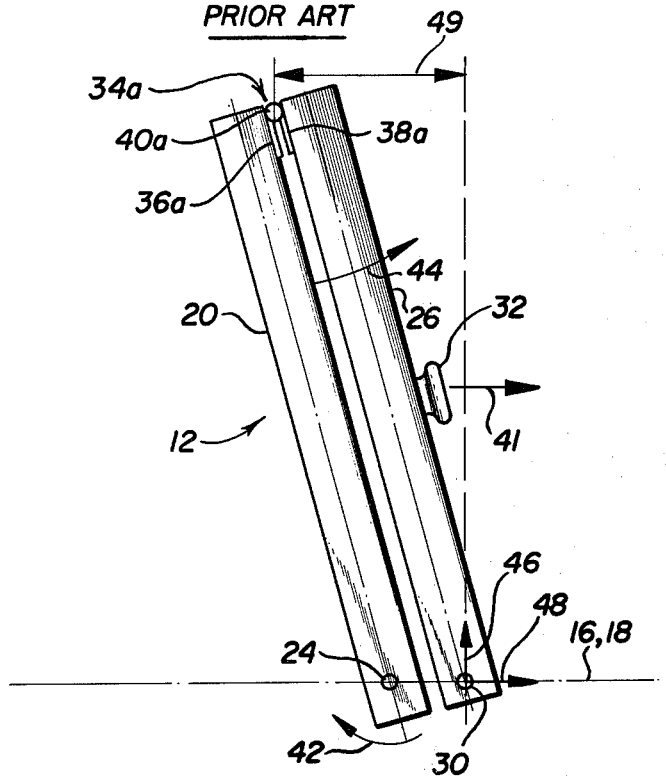
FIG. 3 PRIOR ART
FIG. 3 illustrates schematically, one section of a bifold type door structure utilizing a second type of prior art hinge mounting.

In order to aid in understanding the advantages of the present invention over the prior art structures and arrangements, discussion will next be had to FIGS. 2 and 3 which illustrate two prior art hinge structures embodied in a bifold door assembly. This discussion will be had relative to the mode of operation of these designs and the inherent disadvantages of such structures.

Figure 1:
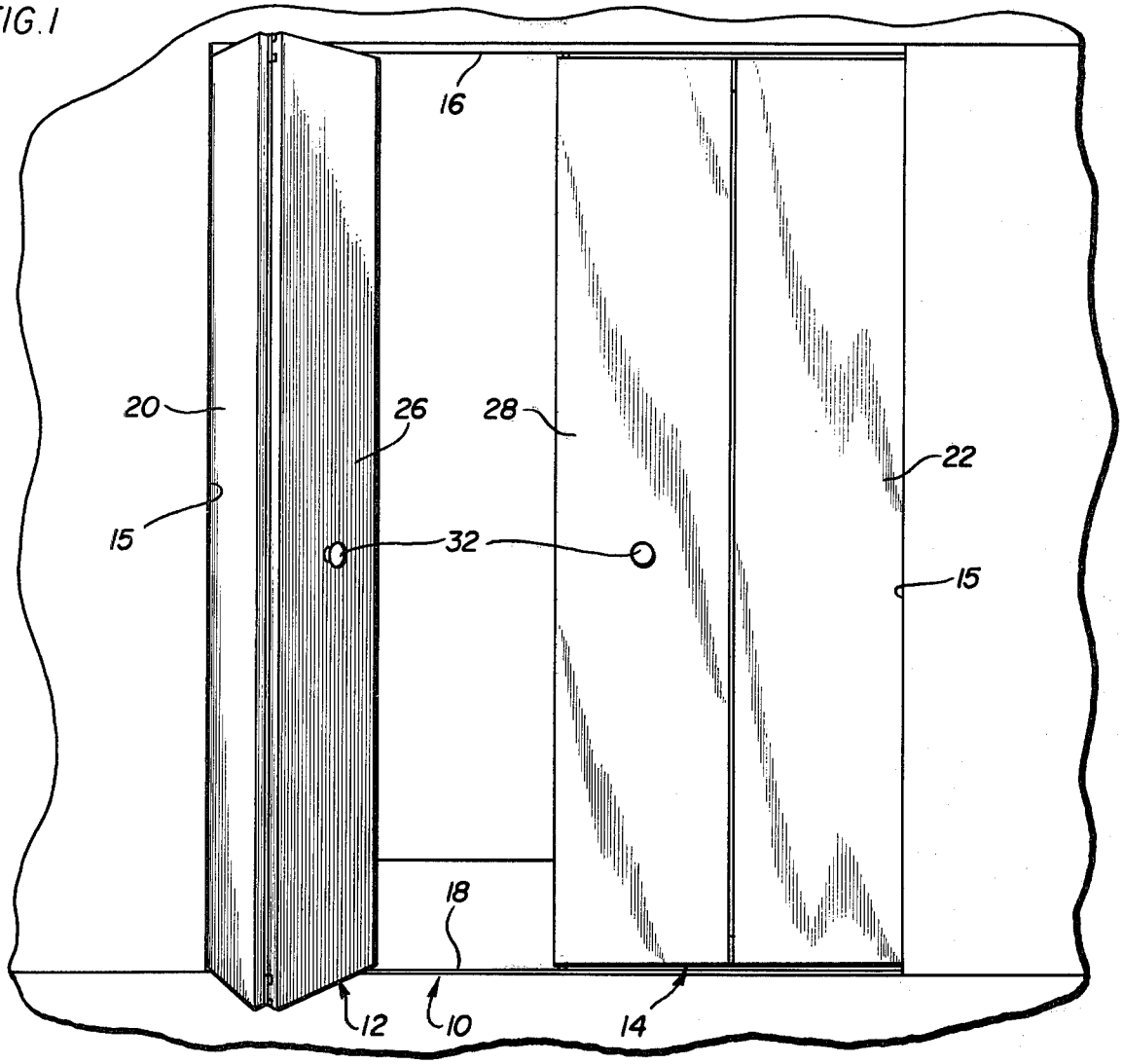
FIG. 1 is a front elevation of a typical bifold door arrangement.

A typical bifold door assembly is illustrated in FIG. 1, and designated generally 10. The door structure 10 is of a four panel design and includes a left-hand pair of bifold door panels designated generally 12 and a substantially similar pair of panels 14 which cooperate to provide a closure for a closet, cabinet or the like. The pairs of panels 12 and 14 are mounted within a door frame indicated generally 15, which includes a pair of substantially parallel horizontal tracks 16, 18 which are affixed to the top and bottom edges, respectively, of the frame 15 of the closet, cabinet or the like.

The respective pairs of door panels 12 and 14 each include a pivoted door panel 20, 22, pivotally affixed to the respective guide tracks 16 and 18 by suitable well known pivot hardware (not shown). Hingedly connected to the pivoted panels 20 and 22 are a guided door panels 26, 28. The door panel members 26 and 28 are also affixed to the tracks 16 and 18, by suitable well known pivot-slide hardware, proximate the edges thereof remote from the frame 15. The guided doors 26, 28 are provided with suitably located external knobs or handles 32 which may be readily grasped to facilitate the opening and closing of the bifold door structure 10.

It should be noted that the pair of door panels 12 are shown in the partially open position, while door panels 14 are in the fully closed condition. Since in any bifold door construction the respective groups of panels are identical, discussion will proceed only with regard to the pair of panels 12. More specifically, said discussion will initially consider the use of two types of prior art hinge mountings with the panels 20 and 26, and finally the hinge mounting provided by the present invention. Further, FIGS. 2–5 are somewhat schematic, and it should be noted that the position of the doors as to the inside and outside panel surfaces have been reversed, for purposes of illustration and discussion.

Referring now to FIG. 2, a first prior art hinge structure, designated generally 34 is illustrated with the door panels 20 and 26, in the fully open condition. The hinge 34 comprises a pair of leaves 36, 38 having interconnected knuckles designated generally 40. It will be noted that the leaves 36 and 38 are affixed to the edge surfaces of the door panels 20 and 26, in such a manner that the knuckles 40 are spaced equally from said edges. Accordingly, when the pivoted door 20 and guided door 26 are in the closed position, similar to FIG. 4, the knuckle 40 will align with the interface provided by said edges.

Further, FIG. 2 illustrates the bifold door arrangement 12 in its fully opened position. In this regard, it should be noted that a pivot member 24 and guide member 30 are affixed to substantially symmetrical points on the exposed edge surfaces of the pivoted door 20 and guided door 26, for engagement in the track portion, represented by datum line 16–18. A similar arrangement of guide and pivot members are used on the opposite surface. In consequence of the symmetrical alignment, of the pivot 24, guide 30 and hinge structure 34, it will be appreciated that the door 12 may not be opened beyond the position illustrated, which defines substantially a 90° angle between the door arrangement 12 and the guide tracks 16 and 18.

It will be noted that in order to close the door arrangement 12, a pulling force must be applied at the knob 32 generally in the direction indicated by the arrow 41. With the door arrangement at substantially a 90° angle, it will be appreciated that the application of force 41 tends to produce rotation of the door panel 26 about the axis of the knuckle 40 of the hinge structure 34, as indicated generally by the arrow 44. Consequently, the resultant force at the point of connection of the guide 30 with the track 16–18, due to this tendency of the door 26 to pivot are indicated by the vectored forces 46 and 48, oriented along the door axis and the track 16–18, respectively. Only a very small component of resultant force is exerted in the direction of the guide tracks 16,18 as indicated generally by the arrow 48, with the major component 46 transverse to the track and tending to produce binding of the slide 30 in the track 16–18. As the guide 30 moves along the track 16–18 in the direction indicated by arrow 48, the angle of inclination increases, and correspondingly vector 46 decreases, as vector 48 increases.

With reference to FIG. 3, one solution proposed in the prior art for increasing the angle of door opening and reducing the binding of the guides is illustrated. It will be noted that the hinge structure 34*a* of FIG. 3 is similar to the hinge structure 34 of FIG. 2, except that it is mounted to the rear surfaces of panels 20 and 26. With the arrangement of FIG. 3, the points for mounting the pivots 24 and guides 30 to the pivoted door 20 and guided door 26, are not uniformly spaced. It will be noted that the guides 30 are attached to the guided door 26 at a location closer to the door edge than the point of attachment of the pivots 24 to the pivoted door 20. In practice, the doors 20 and 26 are predrilled by the manufacturer at different points to accommodate this asymmetrical location of pivots and guides. In consequence of this asymmetrical mounting, it will be seen that the door arrangement 12 may be opened to form an angle somewhat greater than 90° with the guide tracks 16, 18. Therefore, when the closing or pulling force 41 is applied to the knob 32, the vector component 48 directed along the track 16, 18 is greater than the component 46 tending to produce binding, thus the door 12 of FIG. 3 will open more easily than that of FIG. 2. While the arrangement of FIG. 3 substantially decreases the problem of binding, it presents a marked disadvantage, in that the pivoted door or panel and guided door or panel must be separately predrilled, and identified by the manufacturer. Furthermore, an installer must correctly identify and mount each door panel 20 or 26, in order to properly install the bifold door 12 in the manner illustrated in FIG. 3. It will be appreciated that this adds to the expense of manufacture and assembly. In contrast, it is considerably simpler and less expensive to provide two identical doors or panels. Also, a relatively unskilled or inexperienced installer may fail to distinguish between the pivoted door and guided door and thus defeat the purpose of predrilling thereof.

Figure 4:
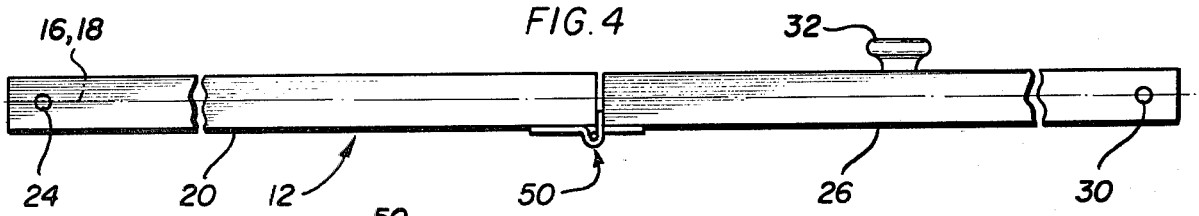
FIGS. 4 and 5 illustrate the bifold door of FIG. 1 in conjunction with the hinge structure according to the present invention, FIG. 4 illustrating the door closed condition and FIG. 5, the door open condition.
Figure 5:
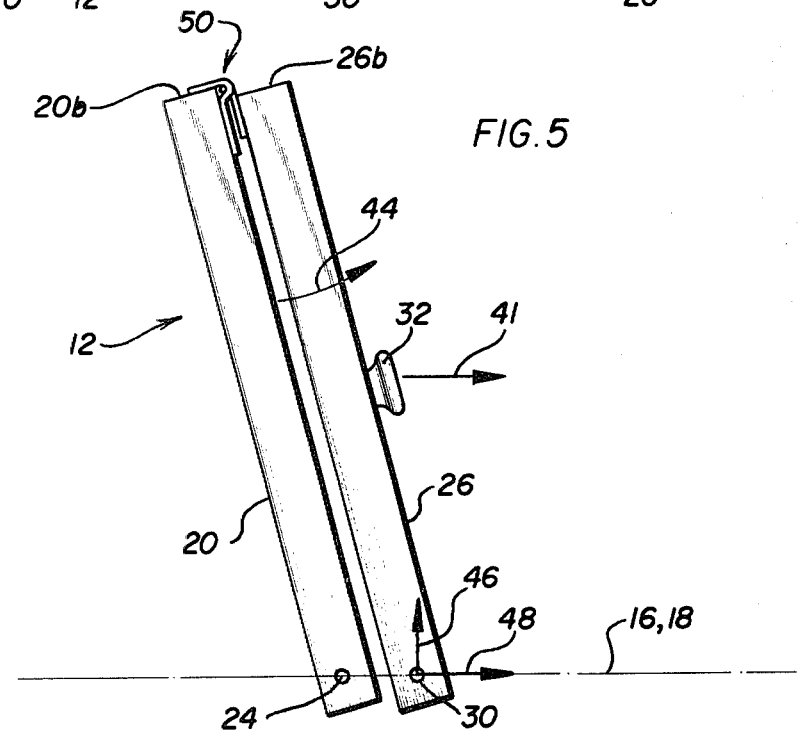

Referring now to FIGS. 4 and 5, the bifold door 12 is illustrated in conjunction with a hinge structure 50 configured and installed in accordance with the principles of this invention. Initially, it will be noted that the guides and pivots 24, 30 are substantially symmetrically located with respect to the door panels comprising the pivoted door 20 and guided door 26, that is they are each spaced the same distance from the adjacent edge surface. As such, predrilling of suitable mounting apertures in the door panels to accommodate the hardware which provide the guides and pivots 30 or 24, does not result in the creation of differing panel structures but involves two substantially identical panel structures. Thus, in contrast to the prior art arrangement of FIG. 3, considerable time and expense is saved by the manufacturer, while eliminating a source of potential error in installation.

Figure 6:
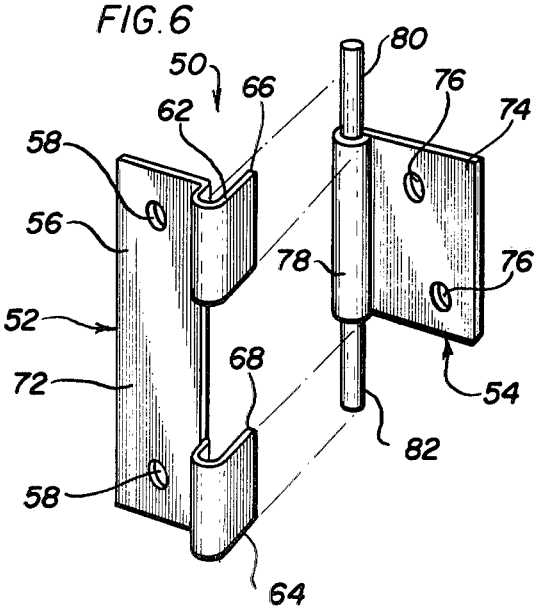
FIG. 6 is an exploded perspective view of one form of a hinge structure in accordance with this invention.
Figure 7:
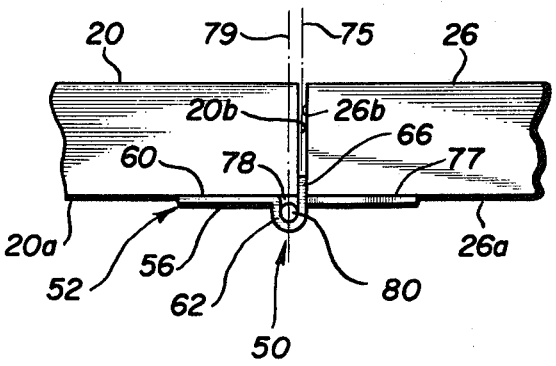
FIG. 7 is an enlarged view of the door edge interface of FIG. 4.

With respect to the hinge structure 50, and referring also to FIGS. 6 and 7, said structure includes a pair of leaf members 52, 54. The leaf member 52 includes a generally flat, plate-like mounting or leaf portion 56 having suitable apertures 58 formed therein to receive screws or the like, for affixing the leaf to a door. The leaf member 52 also includes a pair of knuckle portions 62, 64 formed integrally with the flat leaf portion 56. The knuckle portions 62 and 64, in the illustrated embodiment, are spaced apart along a common side of the leaf member 52, and are substantially semi-circular or U-shaped in cross section to define in effect open knuckle segments or portions. The face end portions of the U-shaped knuckles 62, 64 each include a flange portion 66, 68 which portions 66 and 68 are disposed substantially perpendicular to the leaf portion 56 and extend beyond said portion 56.

Referring now to the leaf member 54, as best seen in FIG. 6, a substantially planar mounting or leaf portion 74 is provided which includes suitable through apertures 76 for receiving mounting screws or the like. The leaf member 54 also includes a generally cylindrical tubular or closed knuckle portion 78 formed integrally with the leaf portion 74 along one side thereof, with a pair of substantially cylindrical rod-like pin members 80, 82 extending coaxially from the knuckle portion 78 in opposite directions. In the illustrated embodiment, the pin members 80, 82 are provided by a single rod element press fitted within the bore defined by the closed knuckle members 78. It will be noted that the axial length of the closed knuckle member 78 is substantially similar to the axial spacing between the open knuckle members 62 and 64 of the leaf member 52. Similarly, the pin members 80 and 82 are preferably of an axial length substantially similar to the axial length of the respective knuckle members 62 and 64 and of a diameter which permits disposition thereof within said U-shaped knuckles.

Thus, upon assembly, the closed knuckle portion 78 and pin members 80, 82 of the leaf member 54 interfit with the open knuckle members 62 and 64 of the leaf member 52 so as to align the respective knuckles coaxially and to rotatably interfit the pin members 80 and 82 within the knuckle portion 62 and 64, thereby defining the assembled hinge structure 50.

Attention is now directed to FIGS. 4, 5 and 7, where the hinge 50 is illustrated assembled to the door panel arrangement 12. Looking initially to FIG. 7, the respective leaves 52 and 54 are first interconnected by the disposition of the pin members 80 and 82 in the open U-shaped knuckles 62 and 64, with the closed knuckle portion 78 being disposed intermediate said open knuckles. The leaves 52 and 54 are then mounted to the door panels 20 and 26, with the leaf 52 affixed to the rear surface **20*a* of the pivoted door panel 20 and the leaf 54 to the rear surface 26*a* of guided door panel 26. As best shown in FIG. 7, the flange portions 66 and 68 are engaged against an edge surface 20*b* of door panel 20. As such, said flange portions 66 and 68 are disposed within the interface between the juxtaposed edge surfaces, which interface is indicated by the datum line 75. The use of the projections or flange portions 66 and 68 of the hinge 50, and the mounting as shown serves two important functions. First, said arrangement insures that the axis of the knuckle portions 62, 64 and 78 will be offset from the interface 75 as indicated by datum line 79, for a purpose to become clear when the operation of the door panel arrangement 20 is considered. Secondly, said flange portions 66 and 68 serve to space the edge surfaces 20*b* and 26*b*** slightly, as is required for proper operation.

An additional important feature of the hinge 50, is that upon mounting as shown in FIG. 7, the panel surface **20*a* cooperates with the open knuckles 62 and 64 to surround and confine the pin members 80 and 82 against lateral movement. Further, with the leaf portions 72 and 74 secured to the door panels 20 and 26, the coaxial alignment or interfit of the closed knuckle 78 between open knuckles 62 and 64 preclude axial separation. Thus, the hinge 50 need only be partially assembled, viz, assembly of pin members 80 and 82**, by the manufacturer, with final assembly being done at the jobsite by the installer in conjunction with mounting of the door panels. As can undoubtedly be appreciated, this feature is of a significant economical advantage.

Attention is invited to FIGS. 4 and 5 in conjunction with which operation of the bifold door 12 with the hinge structure 50 of this invention will be described. It should be recalled that the described mounting of the leaf member 52 aligns the knuckles such that this axis is offset somewhat from the datum line 75 of the door edge interface. The flange members or portions 66, 68 generally define this spacing and the center line 75. As best seen from a comparison of FIGS. 4 and 5, the bifold door 12 may be operated from the closed position of FIG. 4 to the fully open position of FIG. 5. In reaching the fully open position, the door panels 20 and 26 will assume a position defining an angle greater than 90°. Further, and of importance, it can be seen that the obtuse final position is attained with the pivot and guide points 24 and 30 on the respective doors symmetrically located, that is equi-spaced from the adjacent door edge surface. The attainment of this obtuse opening position, in conjunction with the symmetrically positioning of the mounting apertures for the pivot and guides 24 and 32, is possible due to the offset mounting of the hinge 50, which results in the edges **20*b* and 26*b* also being offset with edge 26*b* being shifted toward the track 16, 18**.

With reference to the earlier discussion of the operation of the prior art embodiment of FIG. 3, it will be recalled that an obtuse opening position is extremely desirable, in that it facilitates subsequent closing action. Accordingly, upon applying a closing force 41 to the door 12 of FIG. 5, the component 48 of the resultant force at guide 30 directed along the track 16, 18 will be greater than the component 46, tending to reduce binding. Thus, the door will close smoothly.

Of importance, is the fact that this ease of closing feature is achieved without the need for specially drilled door panels. Thus, the present invention permits the attainment of the advantages of both the prior art embodiments of FIGS. 2 and 3, while eliminating their respective disadvantages.

Specifically, the use of the hinge structure 50 does not require predrilling of differently located or asymmetrical openings for receiving the guides and pivots 24, 30 in the respective pivoted and guided doors 20, 26 thus minimizing the expense of manufacture and packaging of the bifold door structure. Moreover, the hinge 50 need not be preassembled by the manufacturer, as assembly and mounting is readily and easily performed by the installer. It will be noted that the leaves 52 and 54 may further include installation indicia as noted in FIG. 6, which together with the unique configuration of the said leaf members guides the installer, thereby substantially avoiding any possibility of incorrect installation. Thus, considerable efficiency and economy in terms of both time and expense for both manufacturer and installer is achieved by the novel hinge structure of this invention.

While it might appear that the hinge 50 can be mounted to either the guided door 26 or the pivoted door 20, this is not the case. In practice, it has been found that the knuckles of the mounting hinge 50 should be offset in a direction toward the pivoted door 20, in order to maximize the degree of door opening. More specifically, if mounting of the hinge 50 were reversed, rather than the door panels 20 and 26 opening to an obtuse position, i.e. greater than 90°; they would open to an angle of less than 90°; thus restricting access.

The embodiment of the invention illustrated and described above is exemplary of a preferred form of this invention. It is realized that various structural features of the disclosed embodiment may be changed or modified, and indeed certain of these are contemplated. For example, changes in the number of placement of knuckles on the respective leaf members 52 and 54 may be effected; the plural knuckle leaf might carry the pin member, with the single knuckle leaf utilizing the open knuckle construction. The foregoing, as well as other changes and modifications as may occur to those skilled in the art are contemplated as forming a part of this invention insofar as they come within the spirit and scope of the claims appended hereto.

The invention is claimed as follows:

1. In combination, a bifold door assembly comprising: a pivoted door and a guide door, mounted such that they will be in substantially co-planar relation in the closed condition and at least one hinge assembly interconnecting said doors along a vertical edge thereof, aperture means formed in the upper and lower horizontal edge surfaces of said pivoted door at a predetermined distance from the vertical edge of said door to be disposed adjacent a door frame, said aperture means adapted to receive pivot means for the pivotal mounting of said door, and aperture means formed in the upper and lower horizontal edge surfaces of said guide door at a predetermined distance from the vertical edge thereof remote from said pivoted door for the receipt of guide means to be disposed in horizontal linear track means to confine said edge for linear movement upon opening and closing of said assembly, the respective predetermined distances providing for the spacing of said aperture means from the said door edges being substantially equal, and said at least one hinge assembly including first and second interconnected leaf members each leaf member including a planar portion affixed to corresponding side surfaces of the pivoted and guide doors and each leaf member further including knuckle means, which knuckle means are disposed coaxially, said leaf members being mounted with said knuckle means offset from the interface of the respective door edges in a direction toward said pivot door, such that when said doors are in the mounted, fully open condition, said guide door will be disposed at an obtuse angle with respect to the associated track means, which facilitates closing movement, said obtuse disposition being attained with the use of door panels with identically positioned aperture means.

2. The combination of claim 1, wherein said knuckle means includes at least one open, U-shaped knuckle portion formed on said first leaf member, and a closed knuckle portion formed on said second leaf member, with at least one pin member extending therefrom, said pin member being disposed in said open, U-shaped knuckle portion, and said first leaf member mounted to the surface portion of the pivoted door, with said open U-shaped knuckle portion offset from the edge of said pivoted door, such that said surface portion cooperates with said open U-shaped knuckle to confine said pin member and thereby preclude lateral separation of said leaf members.

3. The combination of claim 2, wherein said open, U-shaped knuckle portion opens in a direction transversely of the leaf portion and includes a flange-like free end which extends transversely of the leaf member in said direction to a location which is beyond the planar portion of said leaf, to be engaged with the vertical edge surface of said pivoted door, thereby serving to assist in the positioning of said first leaf member, and assist in attaining and maintaining the offset mounting of the knuckle means.

4. The combination according to claim 2, wherein said knuckle means includes a pair of spaced open U-shaped knuckle portions on said first leaf member, and a pair of oppositely extending pin members on said second leaf member for engagement in said open, U-shaped knuckles, said closed knuckle portion being received between said spaced open knuckle portions, which thereby preclude axial separation of said leaf members when assembled to said pivoted and guide door respectively, the construction of said hinge assembly being such that the respective leafs need not be interconnected until mounted to the guide and pivot doors.

* * * * *